United States Patent [19]

Kibler

[11] 3,974,951

[45] Aug. 17, 1976

[54] PRINTER MECHANISM

[75] Inventor: Alfred G. Kibler, Dayton, Ohio

[73] Assignee: NCR Corporation, Dayton, Ohio

[22] Filed: Nov. 12, 1974

[21] Appl. No.: 523,180

[52] U.S. Cl. ..... 226/143; 226/51; 226/152

[51] Int. Cl.[2] ..... B65H 17/22

[58] Field of Search ..... 226/51, 134, 135, 136, 226/143, 152, 158, 188

[56] References Cited

UNITED STATES PATENTS

| | | | |
|---|---|---|---|
| 2,273,265 | 2/1942 | Heyel | 226/143 |
| 2,332,152 | 10/1943 | Knauer | 226/143 |
| 3,244,095 | 4/1966 | Matthew | 226/143 X |

*Primary Examiner*—Robert B. Reeves
*Assistant Examiner*—Joseph J. Rolla
*Attorney, Agent, or Firm*—J. T. Cavender; Wilbert Hawk, Jr.; Richard W. Lavin

[57] ABSTRACT

There is described a record material feed mechanism for use in an electronic cash register for feeding a record member to a printing station wherein data is printed on print lines located on the record member during the operation of the cash register. The feed mechanism will automatically position each succeeding print line of the record member adjacent the printing station on successive printing operations of the cash register. Included in the feed mechanism are a pair of cam actuated gear segments which control the length of movement of the record member between a home position and a position adjacent the printing station in the cash register. During the feeding of the record member to the printing station, the gear segments are positioned in tandem to move the record member a predetermined length while in a feed-out operation, the segments are positioned in an overlap condition to move the record member a distance which is one print line less than the feed-in movement.

11 Claims, 5 Drawing Figures

PRINTER MECHANISM

BACKGROUND OF THE INVENTION

The present invention is directed to a feed mechanism for feeding a business record to a printing station within a business machine for printing data thereon. In modern day electronic cash registers and data terminal devices, a record slip is positioned on a slip table to be subsequently fed into the cash register where data of the business transaction performed by the cash register is printed thereon. Each subsequent operation of the cash register will result in the printing of data on successive print lines of the record slip until the business transaction is completed, at which time the record slip is removed from the terminal and given to the customer.

In order to process the transaction in the minimum amount of time, it is desirable to have the record slip automatically positioned adjacent the printing station so that the required print line will receive the printed data. Prior mechanisms have utilized a punch mechanism to punch a control aperture in the record slip during each printing operation and a sensing device to position the record slip for the next printing operation upon sensing the control aperture as the record slip is fed back towards its home position. This type of mechanism produces jam-ups of the feed mechanism due to the failure of the sensing mechanism to sense the control aperture in the card. Other mechanisms have used complex and costly control mechanism for adjusting the record slip to print on the desired print line. Therefore, it is an object of this invention to provide a record member feed mechanism for use in a business machine to automatically position a selected print line on a record member adjacent a printing station during succeeding machine operations wich is simple, reliable and inexpensive.

SUMMARY OF THE INVENTION

This object and others are achieved by providing a record member feed mechanism which includes a pair of gear segments mounted in a side-by-side relationship and which together drives a feed roller for moving a record member to and from a printing station located within a business machine. During the feed-in movement of the record member, the segments are positioned in tandem by a pair of cam members to move the record member a predetermined length to position a print line on the record member adjacent a printing station. At the end of the feed-in movement of the record member, the gear segments are moved to an overlap position by the cams wherein during the feed-out movement of the record member, the segments will move the record member a distance which is one print line space less than the feed-in distance. In this latter position, the next print line on the record member will be conditioned to be moved to the printing station for the printing of data thereon during the next print operation.

DESCRIPTION OF THE PREFERRED EMBODIMENT

Figure 1:
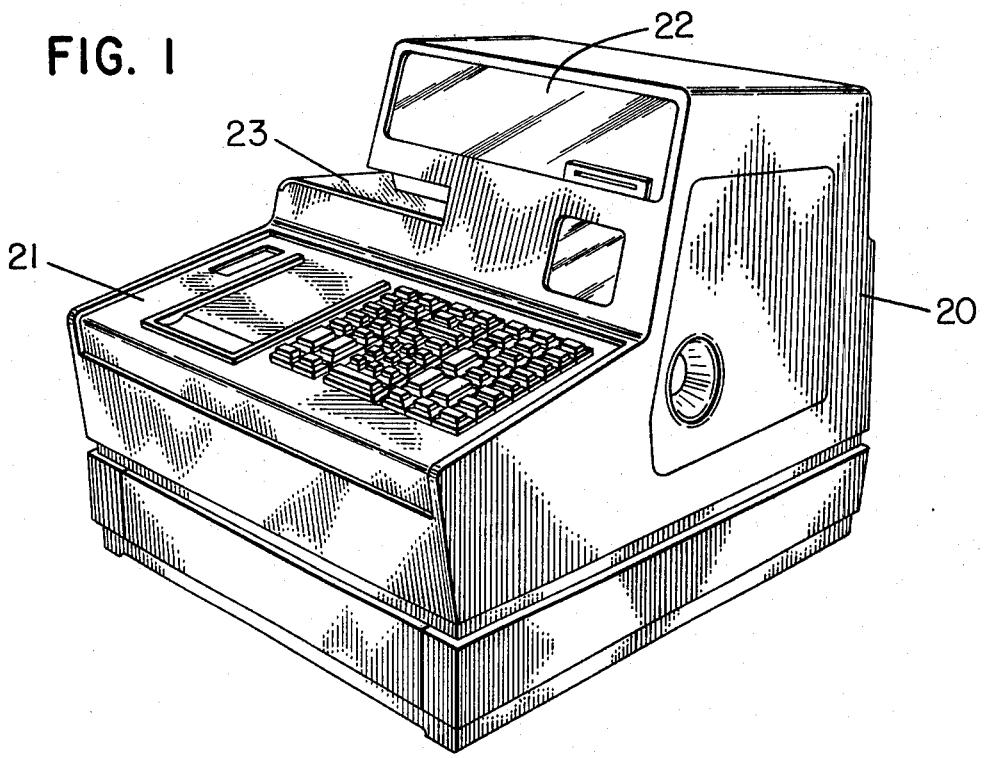
FIG. 1 is a perspective view of the electronic cash register embodying the present invention.

Referring now to FIG. 1, there is shown a perspective view of an electronic cash register 20 for performing merchandizing transactions in which the present invention is utilized. Included in the construction of the cash register 20 are such well known features as a keyboard 21 for inserting merchandise data into the register and an indicator panel 22 for displaying the data so inserted. Located on the left side of the electronic cash register is a slip table 23 on which a record slip 24 (FIG. 2) is placed, the record slip containing a plurality of print lines (not shown) on which the data of the transaction is to be printed. The operator will position the record slip 24 along a guide 25 (FIG. 2) on the slip table 23 with the first printing line aligned with a mark (not shown) on the table 23. After the data of the transaction has been inserted into the keyboard 21 of the cash register and an operation of the cash register has been initiated, the feed mechanism of the instant application will drive the slip 24 forward a predetermined distance to a printing position where the information is printed on the first entry line of the slip. After the printing operation has occurred, the feed mechanism will then feed the slip back out a distance which is one entry line less than the first feed movement. This return movement positions the second entry line of the record slip adjacent the reference mark. Subsequent operation of the cash register will result in the printing of information on each succeeding entry line of the record slip until the transaction is completed. At that time, the slip will be removed from the slip table and given to the customer.

Figure 2:
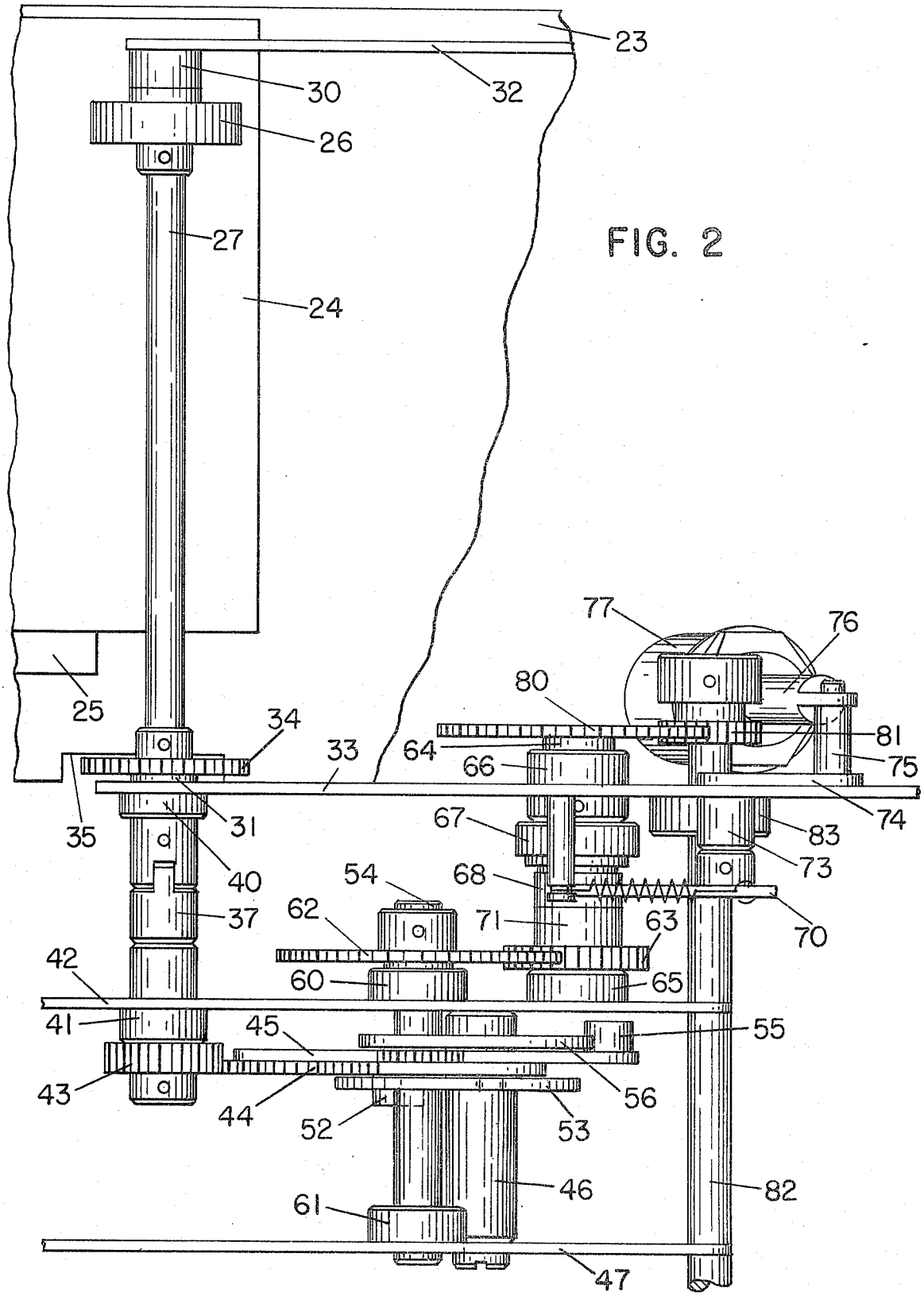
FIG. 2 is a partial detailed top view of the slip feed mechanism.
Figure 3:
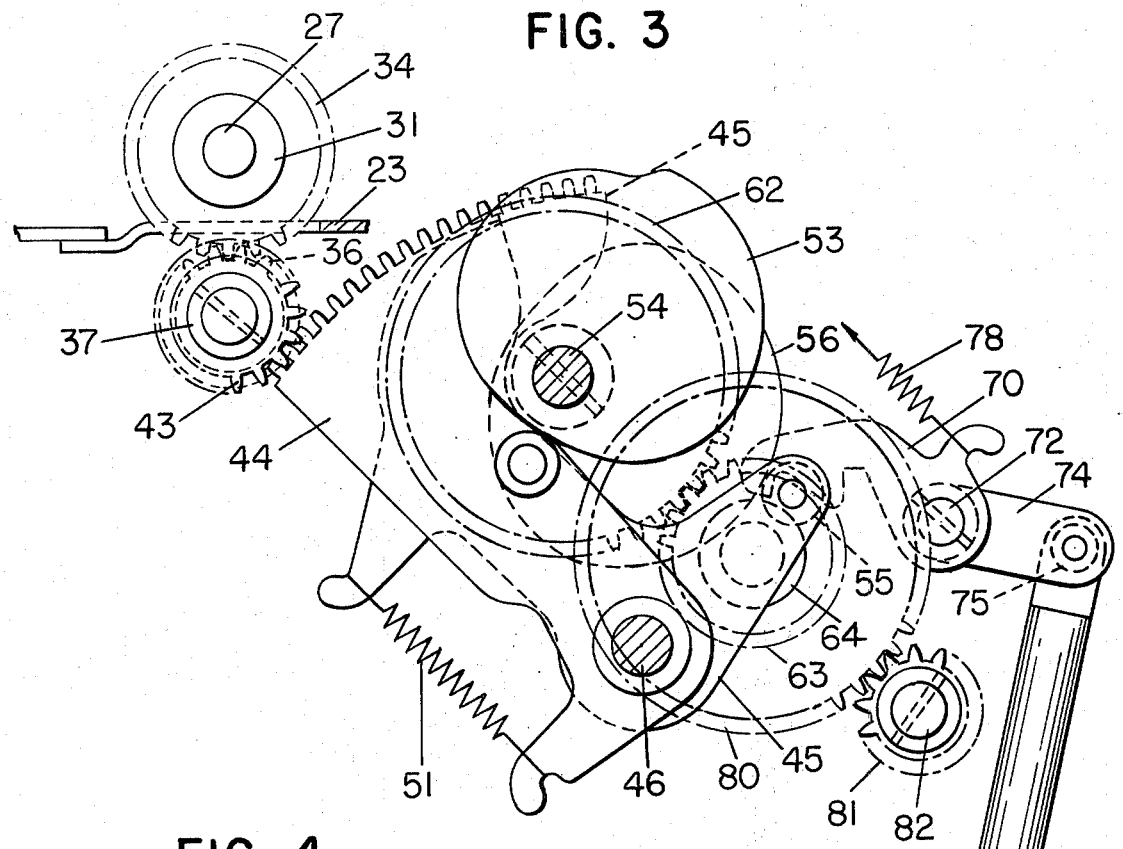
FIG. 3 is a partial detailed side view of the slip feed mechanism showing the gear segments in a tandem position.

Referring to FIG. 2, there is shown a top view of the record slip feed mechanism which includes a drive roller 26 pinned to a drive shaft 27 journaled within bearings 30, 31 secured to the side frames 32, 33 respectfully of the machine. The drive roller 26 coacts with a pressure roller (not shown) in a manner well known in the art to engage the record slip 24 for feeding the slip toward or away from a printing position adjacent a printing mechanism (not shown) located in the cash register. The drive roller 26 is operated by a gear train which includes a drive gear 34 (FIGS. 2 and 3) pinned to the drive shaft 27 adjacent the side frame 33 and which extends through a slot 35 (FIG. 2) in the slip table 23 and into engagement with a feed gear 36 (FIG. 3). The feed gear 36 is pinned to a shaft 37 journaled within bearings 40, 41 (FIG. 2) secured to the side frames 33, 42, respectfully, of the machine. Pinned to the other end of the shaft 37 adjacent the side frame 42 is a second feed gear 43 which engage the tooth edges of a pair of segments 44, 45 (FIGS. 2, 3, and 4) rotatably mounted adjacent to each other on a shaft 46 secured between the side frames 42, 47 (FIG. 2) of the machine.

Figure 5:
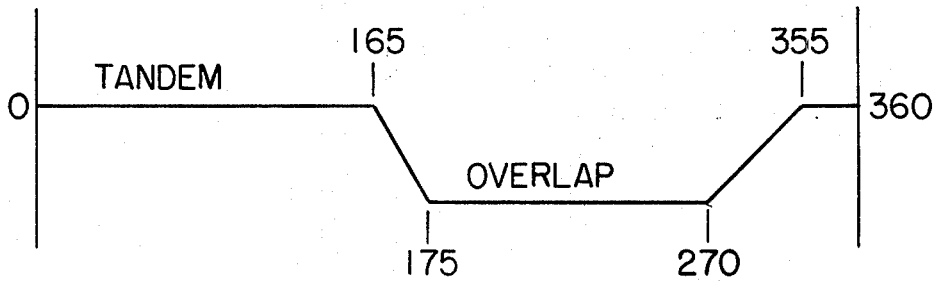
FIG. 5 is a schematic diagram of the timing operation of the cam line showing the positioning of the gear segments by the cam members.
Figure 4:
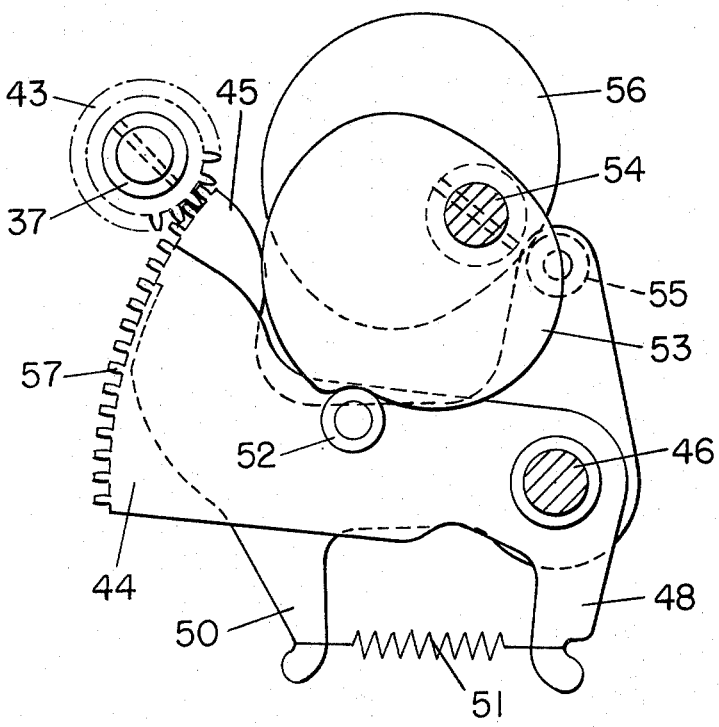
FIG. 4 is a partial detailed side view of the gear segments showing the segments in an overlapped position.
Figure 4:
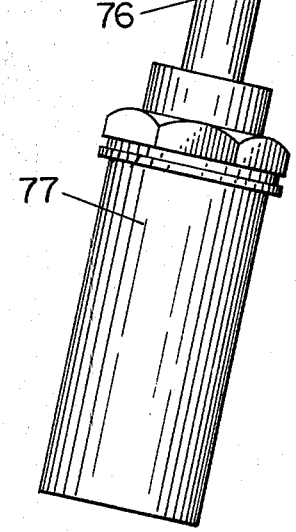

As best seen from FIG. 4, the segment 44 has a depending arm portion 48 while segment 45 has a similar arm portion 50, each of the arm portions engaging a spring 51 mounted therebetween which normally rotates the segments about the shaft 46 in a direction towards each other. As shown in FIG. 4, rotatably mounted on segment 44 is a cam roller 52 which is urged into engagement with a cam 53 secured to a cam shaft 54 by the action of the spring 51. Similarly, a cam roller 55 rotatably mounted on the segment 45 is urged by the spring 51 into engagement with a cam 56 pinned to the cam shaft 54. As will be described more fully hereinafter, clockwise rotation of the cam shaft 54 through 360° will result in the cams 53, 56 rocking the segments 44, 45 in a counter-clockwise direction. During the first 180° rotation of the shaft 54, the segments will be rocked from the position shown in FIG. 3 to the position shown in FIG. 4. This movement of the segments will rotate the gear 43 clockwise resulting in the record slip 24 being moved to a printing position by the feed roller 26. After a printing operation has occurred, the shaft 54 will be rocked through the second 180° of its rotation resulting in the clockwise rotation of the segments 44, 45 by the cams 53, 56 about the shaft 46. This movement results in the rotation of the gear 43 in a counter-clockwise direction which moves the record slip 24 back to its home position. As seen in FIG. 3, the segments 44, 45 are positioned in tandem by the cams 53, 56 at the start of the first feed operation so that during the first counter-clockwise rotation of the segments, the gear teeth 57 of both segments will feed the slip 23 a predetermined distance to the printing position. As shown in FIG. 5, between 165° and 175° of the first 180° rotation of the cam shaft 54, the cam 53 will rock the segment 44 clockwise with relation to the segment 45 under the action of the spring 51 thereby overlapping the tooth surfaces of the segments 44, 45. This movement reduces the total number of teeth 57 that is available to rotate the gear 43 counter-clockwise during the second 180° rotation of the cam shaft 54. This second movement of the gear 43 positions the slip in the home position one entry line less than at the start of the feed-in movement. As shown in FIG. 5, between 270° and 355° of rotation of the cam line 54 the cam 53 will rotate the segment 44 counter-clockwise with respect to segment 45 so that at the end of the clockwise movement of the segments, the segments will be again in a tandem relationship as shown in FIG. 3 preparatory for the next print operation.

As shown in FIG. 2, the cam shaft 54 is rotatably mounted within bearing 60 secured to the side frame 42 and bearing 61 secured to the side frame 47 of the machine. The cam shaft 54 is selectively operated by a drive system which includes a gear member 62 pinned to the cam shaft 54 and which engages a clutch gear 63 rotatably mounted on a clutch shaft 64. As best seen from FIG. 2, the clutch shaft 64 is journaled within a bearing 65 secured to the side frame 42. The other end of the clutch shaft 64 is rotatably mounted within a bearing 66 mounted on the side frame 33. Pinned to the clutch shaft 64 is a clutch drum 67 which engages a spring clutch member 68 having a slot within which is positioned one end of a clutch pawl 70 (FIGS. 2 and 3) for normally holding the spring clutch member 68 in a disengaged position with respect to the clutch shaft 64 in a manner well known in the art. The spring clutch member 68 is positioned adjacent a sleeve member 71 which overlaps the spring portion of the spring clutch adjacent the clutch gear 63. The spring clutch construction is not critical to the present invention and can be of any conventional design, many of which are well known in the art. An example of a spring clutch that may be utilized in the present embodiment is found in U.S. Pat. No. 2,930,463 which issued to Dodge et al. on Mar. 29, 1960.

The clutch pawl 70 (FIGS. 2 and 3) is pinned to a shaft 72 rotatably supported within a bearing member 73 secured to the side frame 33. Secured to the other end of the shaft 72 is an arm 74 to which is mounted a stud 75. Rotatably mounted on the stud 75 is one end of a plunger 76 of a solenoid 77 mounted within the framework of the machine. As shown in FIG. 3, the clutch pawl 70 is normally urged in a counter-clockwise direction by the spring 78 into engagement with the spring clutch 68 disabling the operation of the clutch. Upon the momentary energizing of the solenoid 77, the plunger 76 will rock the shaft 72 and the pawl 70 clockwise against the action of the spring 78, thereby removing the pawl 70 from the spring clutch member 68 releasing the spring clutch to couple the rotation of the clutch shaft 64 to the clutch gear 63.

The clutch shaft 64 is constantly being driven in a clockwise direction by a drive system which includes a drive gear 80 secured to the end of the shaft 64 and which engages a gear 81 secured to the main drive shaft 82 journaled in a bearing 83 secured to the side frame 33. The shaft 83 is constantly rotating in a clockwise direction as viewed in FIG. 3. Upon release of the spring clutch by the clutch pawl 70, the clutch member 68 will engage the clutch shaft 64 and rotate the clutch gear 63 in a counter-clockwise direction and the gear 62 and the cam shaft 54 in a clockwise direction. Rotation of the gear 63 through 360° will rotate the gear 62 through 180°. Since the energizing of th solenoid 77 is momentary, as soon as the clutch member 68 starts to rotate in a counter-clockwise direction, the solenoid 77 is deenergized allowing the spring 78 to rock the pawl 70 counter-clockwise against the clutch member 68. Upon completion of 360° rotation of the clutch member 68, the pawl 70 will snap into the slot (not shown) in the clutch member 68 under the action of the spring 78, thereby disengaging the spring clutch from the clutch shaft 64. The pawl 70 will hold the clutch member 68 and the clutch gear 63 in a disengaged position until the next energizing pulse is received by the solenoid 77.

In the operation of the feed mechanism, after a record slip 24 has been positioned on the slip table 23, the operator will insert data into the keyboard 21 (FIG. 1) of the electronic cash register and initiate a machine operation in a manner that is well known in the art which results in the momentary energizing of the solenoid 77. As described previously, energizing of the solenoid 77 will rock the clutch pawl 70 clockwise against the action of the spring 78, thereby releasing the spring clutch member 68 for a 360° rotation resulting in the cam shaft 54 being rotated through 180° by the clutch gear 63. The clockwise rotation of the cams 53, 56 by the cam shaft 54 through 180° will result in the segments 45, 46 being rocked counter-clockwise, the segments 44, 45 being at this time in a tandem relationship so that the total number of teeth 57 on both segments will rotate the gear 43 and the drive roller 36 a distance to position an entry line on the record slip 24 adjacent the printing mechanism in the cash register which prints the data on the line. At the end of the first 180° rotation of the cam shaft 54, the segments are moved into an overlapped position.

After the printing operation has been completed, the solenoid 77 is again momentarily energized resulting in the rotation of the clutch wheel 63 through 360° and the clockwise rotation of the cam shaft 54 through 180° as described previously. Rotation of the feed gear 43 by the segments 44, 45 when in overlapped condition will feed out the record slip 24 from the printing position to a home position which is one print line space less than the home position of the record slip prior to the feed in movement of the slip to the printing position. Upon reaching this home position, the cams 53, 56 will have moved the segments 44, 45 to a tandem position as shown in FIG. 5 so that they are in position to feed the record slip to a printing position during the next machine operation wherein the next line space on the record slip will be positioned adjacent the printing mechanism for the printing of data thereon. It will thus be seen that this feed mechanism will automatically position each succeeding line space of the record slip adjacent the printing mechanism for printing data thereon during each operation of the cash register, whereby all the data of the transaction will be printed on the record slip.

While the form of the invention shown and described herein is admirably adapted to fulfill the objects primarily stated, it is to be understood that it is not intended to confine the invention to the one form or embodiment disclosed herein, for it is susceptible of embodiment in various other forms.

What is claimed is:

1. A record material feed mechanism comprising:

a. means engaging a record member for moving the record member when operated;

b. a first drive member for operating said moving means to move the record material a distance commensurate with the movement of said first drive member;

c. a second drive member mounted for movement adjacent said first drive member for engaging and moving said first drive member a first predetermined distance when actuated;

d. a third drive member mounted for movement adjacent said first drive member for engaging and moving said first drive member a second predetermined distance when actuated, said second and third drive members mounted in a side-by-side relationship;

e. means engaging said second and third drive members for normally urging said drive members towards an overlapped position;

f. and actuating means engaging said second and third drive members for reciprocally moving said drive members between a first and second actuated position, said actuating means moving the second and third drive members into a tandem position against the action of said engaging means when moving the drive members from said first to said second actuated position whereby the first drive member will move the record material a distance equal to the sum of said first and second predetermined distances, said actuating means further moving the second and third drive members into an overlapped position when moving the drive members from said second position to said first position whereby the record material will be moved a distance less than the sum of said first and second predetermind distances.

2. The feed mechanism of claim 1 in which said actuating means includes:

a. cam members each engaging one of said second and third drive members;

b. and means for operating said cam members whereby said second and third drive members are simultaneously moved by said cam members between said first and second actuated position and between an overlapped and tandem position thereby varying the length of movement of said first drive member.

3. The feed mechanism of claim 1 in which said urging means comprises a spring member engaging each of said second and third drive members for normally urging said drive members towards an overlapped position.

4. A record material feed mechanism comprising:

a. means engaging a record material for moving the record material when operated;

b. a rotatably mounted gear member for operating said moving means to move the record material a distance commensurate to the rotation of said gear member;

c. a first gear segment rotatably mounted adjacent said gear member for engaging and rotating said gear member, when actuated, a first predetermined distance;

d. a second gear segment rotatably mounted adjacent said gear member for engaging and rotating said gear member, when actuated, a second predetermined distance, said first and second gear segments mounted in a side-by-side relationship;

e. means engaging said first and second gear segments for normally urging said segments towards an overlapped position;

f. and actuating means engaging said gear segments for reciprocally rotating said gear segments between a first and second actuated position, said actuating means simultaneously rotating said gear segments into engagement with said gear member for moving the record material a distance commensurate with the rotation of the gear member and positioning said segments under the action of said urging means in a tandem position during movement of the gear segments from said first to said second actuated position and in an overlapped position during movement of the gear segments from said second to said first actuated position whereby the movement of the record material to said first actuated position is less than the movement to said second actuated position.

5. The feed mechanism of claim 4 in which said gear segments each have a predetermined number of gear teeth on their peripheral edge which engage and rotate said gear member upon movement of the gear segments between said first and second actuated position, the number of gear teeth which engage the gear member being changed between an overlapped and tandem position whereby the length of movement of the record material is changed when moved between said first and second actuated positions.

6. The feed mechanism of claim 4 in which a. said urging means comprises a spring member engaging each of said gear segments for normally moving said gear segments toward an overlapped position;

b. said actuating means includes cam members each engaging one of said gear segments;

c. and means for operating said cam members whereby the gear segments are simultaneously moved between said first and second actuated position by said cam members to rotate said gear member and to position said gear segments in an overlapped and tandem position thereby varying the length of rotation of said gear member.

7. The feed mechanism of claim 6 in which said cam member operating means includes a. a rotatably mounted shaft member to which is secured said cam member for rotating said cam members when operated;

b. a constantly operating drive means;

c. a shaft member drive means engaging said shaft member and positioned adjacent said constantly operating drive means;

d. selectively operative clutch means engaging both of said drive means for interconnecting said drive means when operated;

e. and selectively operated actuating means engaging said clutch means for operating said clutch means whereby said shaft member is operated by said constantly operating drive means to rotate said cam members.

8. In a data terminal device constructed and arranged to perform a plurality of printing operations on print lines located on a record member, a mechanism for feeding a record member between a home position and a printing position including:

a. a drive roller engaging the record member for moving the record member a distance commensurate with the rotation of the drive roller;

b. gear means engaging said drive roller for rotating said drive roller when operated;

c. a first rotatably mounted gear segment positioned adjacent said gear means, said gear segment engaging said gear means, when actuated, to operate said gear means to move the record member a predetermined distance between the home position and the printing position;

d. a second rotatably mounted gear segment positioned adjacent said first gear segment, said second gear segment engaging said gear means, when actuated, to operate said gear means to move the record member a predetermined distance between the home position and the printing position;

e. means engaging said gear segments for normally urging said gear segments towards an overlapped position;

f. cam members engaging each of said gear segments for reciprocally actuating said segments between a first and second actuated position and moving said segments between an overlapped and tandem position when operated;

g. and means for operating said cam members whereby said cam members will simultaneously rotate said gear segments into engagement with said gear means for moving the record member a predetermined length and positioning said gear segments under the action of said urging means in a tandem position during movement of the gear segments from said home position to said printing position and in an overlapped position during movement from said printing position to said home position to position a different portion of the record member adjacent the printing position during each succeeding printing operation.

9. The feed mechanism of claim 8 in which said gear segments each have a predetermined number of gear teeth on their peripheral edge which engage and rotate said gear means upon movement of the gear segments between said first and second actuated positions, the number of gear teeth which engage the gear means being changed between an overlapped and tandem position whereby the length of movement of the record material is changed when moved between said first and second actuated positions.

10. The feed mechanism of claim 8 in which said urging means comprises a spring member engaging each of said gear segments for normally urging said gear segments towards an overlapped position.

11. The feed mechanism of claim 8 in which said cam member operating means includes a. a rotatably mounted shaft member to which is secured said cam member for rotating said cam members when operated;

b. a constantly operating drive means;

c. a cam shaft member drive means engaging said shaft member and positioned adjacent said constantly operating drive means;

d. selectively operated clutch means engaging both of said drive means for interconnecting said drive means when operated;

e. and selectively operated actuating means engaging said clutch means for operating said clutch means whereby said shaft member is operated by said constantly operating drive means to rotate said cam members.

* * * * *